US012071725B2

(12) United States Patent
Xie et al.

(10) Patent No.: US 12,071,725 B2
(45) Date of Patent: Aug. 27, 2024

(54) JUNCAO PULP FOR SPINNING AND PREPARATION METHOD AND USE THEREOF

(71) Applicant: XINXIANG CHEMICAL FIBRE CO., LTD., Henan (CN)

(72) Inventors: Yueting Xie, Henan (CN); Changjin Shao, Henan (CN); Zhengfeng Zhang, Henan (CN); Faquan Yao, Henan (CN); Shanjing Xing, Henan (CN); Junjiang Xiao, Henan (CN); Yijie Hu, Henan (CN); Kun Ding, Henan (CN)

(73) Assignee: XINXIANG CHEMICAL FIBRE CO., LTD., Xinxiang (CN)

( * ) Notice: Subject to any disclaimer, the term of this patent is extended or adjusted under 35 U.S.C. 154(b) by 0 days.

(21) Appl. No.: 18/263,962

(22) PCT Filed: Mar. 20, 2023

(86) PCT No.: PCT/CN2023/082466

§ 371 (c)(1),
(2) Date: Nov. 27, 2023

(87) PCT Pub. No.: WO2024/016698

PCT Pub. Date: Jan. 25, 2024

(65) Prior Publication Data

US 2024/0084507 A1 Mar. 14, 2024

(30) Foreign Application Priority Data

Jul. 22, 2022 (CN) ..... 202210862610.7
Aug. 30, 2022 (CN) ..... 202211048526.8

(51) Int. Cl.

| | |
|---|---|
| ***D21H 11/12*** | (2006.01) |
| ***D21B 1/02*** | (2006.01) |
| ***D21C 3/00*** | (2006.01) |
| ***D21C 3/02*** | (2006.01) |
| ***D21C 3/22*** | (2006.01) |
| ***D21C 9/14*** | (2006.01) |
| ***D21C 9/16*** | (2006.01) |
| *D01D 1/02* | (2006.01) |
| *D01F 1/02* | (2006.01) |
| *D01F 2/00* | (2006.01) |

(52) U.S. Cl.

CPC ..... *D21H 11/12* (2013.01); *D21B 1/023* (2013.01); *D21C 3/003* (2013.01); *D21C 3/02* (2013.01); *D21C 3/222* (2013.01); *D21C 9/14* (2013.01); *D21C 9/163* (2013.01); *D01D 1/02* (2013.01); *D01F 1/02* (2013.01); *D01F 2/00* (2013.01); *D10B 2201/01* (2013.01)

(58) Field of Classification Search

CPC ..... D21C 3/003; D21C 3/02; D21C 3/222; D21H 11/12; D10B 2201/01

See application file for complete search history.

(56) References Cited

U.S. PATENT DOCUMENTS 4,594,130 A 6/1986 Chang

FOREIGN PATENT DOCUMENTS

CN 106958044 A * 7/2017
WO 2009/015555 A1 2/2009

OTHER PUBLICATIONS

Liu et al., Abstract of CN 113481741 A, Oct. 8, 2021. (Year: 2021).*
Faina Innovations, Hybrid Napier grass varieties—Packchong1 and Juncao, 2024 (Year: 2024).*
Ma et al: "Experimental study on the use of reeds in the production of dissolving pulp", Artificial Fibre, China Academic Journal Electronic Publishing House, vol. 44, No. 1, Feb. 28, 2014.
Wei et al: Application of Surfactants in Paper—Making Industry, Guangzhou Chemical Industry, Mar. 25, 2003.

* cited by examiner

*Primary Examiner* — Anthony Calandra
(74) *Attorney, Agent, or Firm* — WCF IP

(57) ABSTRACT

Disclosed are a pulp for Juncao spinning and a preparation method and use thereof. The method includes: placing a Juncao in a solution prepared from a lye, a catalyst, and an auxiliary agent and cooking to obtain a cooked solution, and then subjecting the cooked solution to pulping to obtain the pulp for Juncao spinning.

14 Claims, No Drawings

JUNCAO PULP FOR SPINNING AND PREPARATION METHOD AND USE THEREOF

CROSS REFERENCE TO RELATED APPLICATION

The present application is a national stage application of International Patent Application No. PCT/CN2023/082466, filed on Mar. 20, 2023, which claims the priorities of Chinese Patent Application No. CN2022108626107, entitled "Juncao pulp for spinning and preparation method and use thereof" filed with the China National Intellectual Property Administration (CNIPA) on Jul. 22, 2022, and Chinese Patent Application No. CN2022110485268, entitled "Juncao pulp for spinning and preparation method and use thereof" filed with the CNIPA on Aug. 30, 2022, all of which are incorporated herein by reference in their entirety.

TECHNICAL FIELD

The present disclosure belongs to the technical field of new chemical textile materials, and in particular relates to a Juncao pulp for spinning and a preparation method and use thereof.

BACKGROUND

Since the Juncao plants were introduced into China, scientific and technological personnel have vigorously developed the Juncao industrial technology of "replacing wood with grass". At present, Juncao has been widely used in the aspects such as the cultivation of edible-medicinal fungi, the improvement of soil moisture retention characteristics, and the cultivation of saline-alkali land to further reduce the degree of desertification in China and improve the ecological environment for green development. Juncao cultivation can realize the comprehensive utilization of agricultural resources such as water resources, sunlight, and heat energy. The growth cycle of the Juncao is much lower than that of forest resources such as trees. Juncao has a high yield, and the root system of the Juncao can continue to multiply and grow after being felled and harvested. The Juncao can promote the development of a plant recycling industry chain and bring extensive economic benefits to society. For example, a Juncao variety "Lvzhou No. 1", which is widely planted in the north of China, has the advantages such as a yield of not less than 25 tons per mu, normal survival at −30° C., and an ability to grow without water for 120 consecutive days.

At present, biomass Juncao cellulose is only used for agricultural planting and ecological restoration, has not yet been applied in the field of new chemical fiber textile materials, and has a considerable comprehensive utilization value. However, chemical fibers and wood pulp used in textiles have high costs, resulting in high production costs for downstream textile enterprises. Moreover, due to the impact of the epidemic, foreign wood pulp and cotton pulp cannot be supplied to domestic manufacturers in time for production use, resulting in insufficient domestic stock. Therefore, it is of great significance to develop a Juncao pulp for spinning that can replace wood pulp and cotton pulp.

SUMMARY

In view of the problems and deficiencies in the prior art, an object of the present disclosure is to provide a Juncao pulp for spinning and a preparation method and use thereof.

To achieve the above object, the present disclosure adopts the following technical solutions:

A first aspect of the present disclosure is to provide a method for preparing a Juncao pulp for spinning, comprising: placing a Juncao in a solution prepared from a lye, a catalyst, and an auxiliary agent and cooking to obtain a cooked solution, and then subjecting the cooked solution to pulping to obtain the Juncao pulp for spinning; where the catalyst is a metal chloride salt, and the auxiliary agent is at least one selected from the group consisting of a polyether water-soluble organic matter and a bicarbonate.

In some embodiments, the metal chloride salt is at least one selected from the group consisting of cobalt chloride, calcium chloride, ferric chloride, ferrous chloride, and nickel chloride.

In some embodiments, the polyether water-soluble organic matter is selected from the group consisting of aromatic polyoxyethylene ether, polyethylene oxide, and polyvinyl ether.

In some embodiments, the polyether water-soluble organic matter is polyethylene oxide.

In some embodiments, the polyethylene oxide has a degree of polymerization of 9 to 12.

In some embodiments, the polyethylene oxide has a degree of polymerization of 10.

In some embodiments, the polyethylene oxide has a purity of 95 wt % to 99 wt %.

In some embodiments, the polyethylene oxide has a purity of 95 wt %.

In some embodiments, the bicarbonate is selected from the group consisting of sodium bicarbonate and potassium bicarbonate.

In some embodiments, the bicarbonate is replaced by a carbonate; and carbonate is selected from the group consisting of potassium carbonate and sodium carbonate.

In some embodiments, the Juncao is calculated based on a dry Juncao; the polyether water-soluble organic matter is calculated based on an active ingredient; an additive amount of the catalyst is in a range of 0.01 wt % to 0.3 wt % of the Juncao; an additive amount of the bicarbonate is in a range of 0.01 wt % to 0.1 wt % of the Juncao; and a volume/mass ratio of the polyether water-soluble organic matter to the Juncao is in a range of (1-12)/(2-3) mL/kg.

In some embodiments, the lye is selected from the group consisting of a potassium hydroxide solution and a sodium hydroxide solution; and the lye has a concentration of 105 g/L to 120 g/L.

In some embodiments, the cooking is conducted at a temperature of 160° C. to 175° C.; and the cooking is conducted for 4 h to 6 h.

In some embodiments, further comprising subjecting the Juncao to a pretreatment before placing the Juncao in the solution and cooking; wherein the pretreatment is conducted by a first process comprising: subjecting the Juncao to cutting, disinfection, and drying, then screening to obtain an internode Juncao, and subjecting the internode Juncao to high-temperature preheating, and then cooking. The above steps can reduce the sugar content of the prepared pulp.

In some embodiments, the disinfection is conducted with a disinfectant, and the disinfectant is at least one selected from the group consisting of an alcohol solution, an acid solution, and a diol derivative; and the disinfection is conducted at a temperature of 25° C. to 45° C.

In some embodiments, the high-temperature preheating is conducted at a temperature of 135° C. to 175° C.; and the high-temperature preheating is conducted for 30 min to 120 min. The high-temperature preheating can promote the Juncao itself to produce organic acids, thus facilitating the precipitation of hemicellulose, saving costs, and facilitating mass production of the Juncao pulp for spinning.

In some embodiments, the first process further comprises after the high-temperature preheating, washing the Juncao repeatedly with water to remove impurities before cooking; and the washing is conducted at a temperature of 30° C. to 100° C.

In some embodiments, subjecting the cooked solution to the pulping is performed by a second process comprising: subjecting the cooked solution to beating and bleaching to obtain a bleached pulp, and subjecting the bleached pulp to papermaking and molding to obtain the Juncao pulp for spinning.

In some embodiments, the beating is conducted with a rotation speed of 8.0 r/s to 8.5 r/s; the beating is conducted at a temperature of 15° C. to 35° C.; the beating is conducted with a belt transmission ratio of 260 to 285; and the beating is conducted for 0.5 h to 1 h.

In some embodiments, the bleaching is conducted with a bleaching agent, and the bleaching agent is any one selected from the group consisting of hydrogen peroxide, chlorine dioxide, sodium hypochlorite, and calcium hypochlorite.

In some embodiments, the bleaching is conducted for 10 min to 60 min, and the bleaching is conducted at a temperature of 30° C. to 70° C.

In some embodiments, after subjecting the cooked solution to beating and bleaching, and before subjecting the bleached pulp to papermaking and molding to obtain the Juncao pulp for spinning, the second process further comprises adding an ash-iron removal agent to the bleached pulp.

In some embodiments, the papermaking and molding are conducted on the bleached pulp with desalted water in a spraying amount of 30 $m^3$/h to 45 $m^3$/h.

In some embodiments, the ash-iron removal agent is added in an amount of 0.01% to 0.08% of a bone dry pulp.

A second aspect of the present disclosure is to provide a Juncao pulp for spinning prepared by the method described above.

A third aspect of the present disclosure is to provide use of the Juncao pulp for spinning described above in spinning.

Compared with the prior art, the present disclosure has the following advantages:

1. In the present disclosure, the Juncao is subjected to a high-temperature preheating treatment, then cooked in the presence of an appropriate amount of the catalyst and auxiliary agent, and finally pulped to obtain the Juncao pulp for spinning. In the present disclosure, the research and development of the efficient preparation of the Juncao pulp for spinning have been realized, which will greatly improve the comprehensive additional value of the Juncao, has broad prospects, and can bring better economic benefits for mass production of enterprises.

2. In the present disclosure, a metal chloride salt is selected as the catalyst, and a polyether water-soluble organic matter and/or a bicarbonate (or a carbonate) is/are selected as an auxiliary agent. The metal chloride salt can promote the breaking of glucosidic bonds in the cellulose during alkalization, thereby accelerating the degradation of the cellulose. The polyether water-soluble organic matter can significantly reduce the surface tension of the lye, and promote penetration of the lye into cellulose molecules. The bicarbonate or carbonate in a solution can penetrate a crystallization region of the cellulose to increase the void volume of the fiber. The catalyst and the auxiliary agent are simultaneously added to the reaction system. In particular, when the polyether water-soluble organic matter is compounded with the bicarbonate (or carbonate) as the auxiliary agent, their synergistic effect could be used to strengthen the penetration and evacuation of the Juncao fiber, accelerate the oxidative degradation of the fiber, reduce the degree of polymerization of the fiber, effectively reduce fiber viscosity, and is conducive to the efficient extraction of the Juncao fiber.

3. In the present disclosure, the internode Juncao is selected for production research and development, while nodules and moldy materials are removed, such that an internode part of the Juncao accounts for not less than 98% of input raw materials. The Juncao pulp for spinning has a high quality and desirable physical and chemical indexes (showing a fiber viscosity of 14 mPa·s to 20 mPa·s and an α-cellulose content of not less than 91%). Meanwhile, the method provided in the present disclosure has low corrosion to production equipment, safe and stable operation procedures, and an environmental-friendly and pollution-free preparation process and can realize the absolute advantages of high-value reuse of Juncao raw materials and help the energy-saving and emission-reduction actions of the chemical fiber industry.

4. The present disclosure provides a new concept for the development and utilization of Juncao raw materials. According to the characteristics of Juncao raw materials such as wide planting area and extremely rich output, the present disclosure can meet the demand of domestic textile enterprises for the amount of plant cellulose and greatly reduce the material cost of plant fibers in chemical fiber enterprises. At the same time, under the national strategic layout, through the high-value utilization of biomass Juncao, "replacing wood with grass" can reduce forest tree felling to further protect the ecological environment. This is also in line with the strategic requirements of the national efficient development.

5. The pulp for spinning generally needs to meet the following standards: a fiber viscosity (which is determined by the cuprammonium method)<20 mPa·s, an α-cellulose content≥90.0%, a pentosan content<7%, and a reaction performance (which is determined by the viscose filtration method)<500 s. In the present disclosure, the Juncao pulp for spinning with excellent performance prepared by adding the catalyst and the auxiliary agent during the cooking has a fiber viscosity of 14 mPa s to 20 mPa·s, an α-cellulose content of 91.0% to 94.0%, a pentosan content of less than 4.92%, a resin content of less than 0.13%, and a reaction performance of 0 s to 250 s, which are in line with the standards of the pulp for spinning.

DETAILED DESCRIPTION OF THE EMBODIMENTS

The present disclosure is further described below in conjunction with specific examples, but the scope of the present disclosure is not limited thereto.

Example 1

A method for preparing a Juncao pulp for spinning was performed by the following procedures:

(1) A dried or fresh Juncao was taken and cut into block materials with a side length of 1 cm to 2.5 cm. The block materials were disinfected with an ethanol solution at a concentration of 50% to 95%, obtaining a disinfected Juncao. The disinfected Juncao was washed repeatedly with water, dried, and selected, obtaining an internode Juncao such that an internode part accounted for not less than 98% of input raw material for further use.

(2) 2 kg of the prepared Juncao raw material was taken, placed in a cooking vessel, and subjected to a preheating treatment with a mixed medium of steam and water at 170° C. for 100 min, obtaining a preheated Juncao raw material.

(3) The preheated Juncao raw material was put into the cooking vessel again after removing impurities with water, and 8 L of a sodium hydroxide solution with a concentration of 120 g/L, 2 g of ferrous chloride, 5 mL of polyethylene oxide (degree of polymerization=10, purity=95 wt %), and 2.5 g of sodium bicarbonate were added thereto in sequence, obtaining a mixture. The mixture was cooked at 170° C. for 5 h, obtaining a Juncao preliminary pulp.

(4) The Juncao preliminary pulp obtained from step (3) was subjected to beating at 30° C. for 0.5 h, obtaining a beat pulp. The beat pulp was subjected to bleaching, and an ash-iron removal agent was then added thereto, obtaining a treated pulp. The treated pulp was subjected to papermaking, pressing, and molding, obtaining a Juncao pulp for spinning.

In the present disclosure, the fiber viscosity was determined by the cuprammonium method, and the reaction performance of the Juncao pulp for spinning was determined by the viscose filtration method.

The viscose filtration method was performed as follows: the pulp sample was dissolved in a mixed solution of NaOH and carbon disulfide to form a viscose, and then the viscose was filtered through a filter screen of 10,000 holes/$cm^2$. A graduated cylinder was placed under the filter screen. A stopwatch was pressed when a filtrate in the graduated cylinder reached 25 mL, and a time S1 was recorded when reaching 50 mL. The stopwatch was pressed again when reaching 125 mL, and a time S2 was recorded when reaching 150 mL. The reaction performance=S2-S1.

The reaction performance reflects the degree of dissolution or uniformity of the pulp. The fiber gel solution prepared from the dissolving pulp with low reaction performance generally contains different degrees of undissolved/semi-dissolved components, which are easy to block micropores of the spinning nozzle, resulting in processing difficulties and affecting the quality of silk, increasing the consumption of carbon disulfide per unit of product, and bringing negative impacts on viscose fiber production in terms of cost, efficiency, product quality, and environmental protection.

In this example, the physical and chemical indexes of the prepared Juncao pulp for spinning were as follows: a fiber viscosity of 14.5 mPa s, an α-cellulose content of 91.3%, a pentosan content of 4.92%, a resin content of 0.13%, and a reaction performance of 52 s.

Example 2

A method for preparing a Juncao pulp for spinning was performed by the following procedures:

(1) A dried or fresh Juncao was taken and cut into block materials with a side length of 1 cm to 2.5 cm. The block materials were disinfected with an ethanol solution at a concentration of 50% to 95%, obtaining a disinfected Juncao. The disinfected Juncao was washed repeatedly with water, dried, and selected, obtaining an internode Juncao such that an internode part accounted for not less than 98% of input raw materials for further use.

(2) 2 kg of the prepared Juncao raw material was taken, placed in a cooking vessel, and subjected to a preheating treatment with a mixed medium of steam and water at 170° C. for 2 h, obtaining a preheated Juncao raw material.

(3) The preheated Juncao raw material was put into the cooking vessel again after removing impurities with water, and 8 L of a potassium hydroxide solution with a concentration of 120 g/L, 4.0 g of ferrous chloride, 10 mL of polyethylene oxide (degree of polymerization=10, purity=95 wt %), and 2.5 g of sodium bicarbonate were added thereto in sequence, obtaining a mixture. The mixture was cooked at 170° C. for 5 h, obtaining a Juncao preliminary pulp.

(4) The Juncao preliminary pulp obtained from step (3) was subjected to beating at 30° C. for 0.5 h, obtaining a beat pulp. The beat pulp was subjected to bleaching, and an ash-iron removal agent was then added thereto, obtaining a treated pulp. The treated pulp was subjected to papermaking, pressing, and molding, obtaining a Juncao pulp for spinning.

In this example, the physical and chemical indexes of the prepared Juncao pulp for spinning were as follows: a fiber viscosity of 14.3 mPa s, an α-cellulose content of 91.4%, a pentosan content of 4.7%, a resin content of 0.07%, and a reaction performance of 234 s.

Example 3

A method for preparing a Juncao pulp for spinning was performed by the following procedures:

(1) A dried or fresh Juncao was taken and cut into block materials with a side length of 1 cm to 2.5 cm. The block materials were disinfected with an ethanol solution at a concentration of 50% to 95%, obtaining a disinfected Juncao. The disinfected Juncao was washed repeatedly with water, dried, and selected, obtaining an internode Juncao such that an internode part accounted for not less than 98% of input raw materials for further use.

(2) 2 kg of the prepared Juncao raw material was taken, placed in a cooking vessel, and subjected to a preheating treatment with a mixed medium of steam and water at 169° C. for 100 min, obtaining a preheated Juncao raw material.

(3) The preheated Juncao raw material was put into the cooking vessel again after removing impurities with water, and 8 L of a potassium hydroxide solution with a concentration of 115 g/L, 3 g of ferrous chloride, and 10 mL of polyethylene oxide (degree of polymerization=10, purity=95 wt %) were added thereto in sequence, obtaining a mixture. The mixture was cooked at 170° C. for 6 h, obtaining a Juncao preliminary pulp.

(4) The Juncao preliminary pulp obtained from step (3) was subjected to beating at 30° C. for 0.5 h, obtaining a beat pulp. The beat pulp was subjected to bleaching, and an ash-iron removal agent was then added thereto, obtaining a treated pulp. The treated pulp was subjected to papermaking, pressing, and molding, obtaining a Juncao pulp for spinning.

In this example, the physical and chemical indexes of the prepared Juncao pulp for spinning were as follows: a fiber viscosity of 18.7 mPa s, an α-cellulose content of 91.7%, a pentosan content of 5.28%, a resin content of 0.08%, and a reaction performance of 22 s.

Example 4

A method for preparing a Juncao pulp for spinning was performed by the following procedures:

(1) A dried or fresh Juncao was taken and cut into block materials with a side length of 1 cm to 2.5 cm, The block materials were disinfected with an ethanol solution at a concentration of 50% to 95%, obtaining a disinfected Juncao. The disinfected Juncao was washed repeatedly with water; dried, and selected, obtaining an internode Juncao such that an internode part accounted for not less than 98% of input raw materials for further use.

(2) 2 kg of the prepared Juncao raw material was taken, placed in a cooking vessel, and subjected to a preheating treatment with a mixed medium of steam and water at 170° C. for 1 h, obtaining a preheated Juncao raw material.

(3) The preheated Juncao raw material was put into the cooking vessel again after removing impurities with water, and 8 L of a potassium hydroxide solution with a concentration of 120 g/L, 4.0 g of ferrous chloride, and 6 mL of polyethylene oxide (degree of polymerization=10, purity=95 wt %) were added thereto in sequence, obtaining a mixture. The mixture was cooked at 169° C. for 4.5 h, obtaining a Juncao preliminary pulp.

(4) The Juncao preliminary pulp obtained from step (3) was subjected to beating at 30° C. for 0.5 h, obtaining a beat pulp. The beat pulp was subjected to bleaching, and an ash-iron removal agent was then added thereto, obtaining a treated pulp. The treated pulp was subjected to papermaking, pressing, and molding, obtaining a Juncao pulp for spinning.

In this example, the physical and chemical indexes of the prepared Juncao pulp for spinning were as follows: a fiber viscosity of 19.8 mPa s, an α-cellulose content of 93.8%, a pentosan content of 6.66%, a resin content of 0.16%, and a reaction performance of less than 500 s.

Comparative Example 1

Comparative Example 1 was basically the same as Example 1, except that no catalyst was added during the cooking.

In Comparative Example 1, the physical and chemical indexes of the prepared Juncao pulp for spinning were as follows: a fiber viscosity of 21.7 mPa s, an α-cellulose content of 91.8%, a pentosan content of 4.38%, a resin content of 0.13%, and a reaction performance of greater than 500 s.

Comparative Example 2

Comparative Example 2 was basically the same as Example 1, except that no auxiliary agent was added during the cooking.

In Comparative Example 2, the physical and chemical indexes of the prepared Juncao pulp for spinning were as follows: a fiber viscosity of 22.4 mPa s, an α-cellulose content of 92.6%, a pentosan content of 5.51%, a resin content of 0.14%, and a reaction performance of greater than 500 s.

Comparative Example 3

Comparative Example 3 was basically the same as Example 1, except that no catalyst or auxiliary agent was added during the cooking.

In Comparative Example 3, the physical and chemical indexes of the prepared Juncao pulp for spinning were as follows: a fiber viscosity of 125.7 mPa s, an α-cellulose content of 88.2%, a pentosan content of 16.68%, and a reaction performance of greater than 500 s.

From the above experimental results, it can be seen that no catalyst or auxiliary agent is added during the cooking of Comparative Example 3. The prepared pulp has higher fiber viscosity and lower α-cellulose content and does not meet the standards of pulp for spinning. After adding the catalyst (Comparative Example 2) or the auxiliary agent (Comparative Example 1), the fiber viscosity of the pulp decreases significantly, but the reaction performance does not meet the standards of pulp for spinning. However, when the catalyst and the auxiliary agent (Examples 1 to 4) are added at the same time, the fiber viscosity of the prepared Juncao pulp for spinning can be reduced from 14 mPa s to 20 mPa s. In particular, when the auxiliary agent is a mixture of the polyether water-soluble organic matter and the bicarbonate (Examples 1 to 2), the Juncao pulp for spinning has a fiber viscosity that is maintained within a range of 14.0 mPa·s to 15.0 mPa·s and has an excellent reaction performance.

The above results show that the catalyst and auxiliary agent have a great influence on the fiber viscosity, resin content, and reaction performance of the pulp during cooking. This is because the catalyst can break the glucosidic bonds in the cellulose during the alkalization, thereby promoting the degradation of cellulose. The polyether water-soluble organic matter can effectively reduce the surface tension of the lye, and facilitate the penetration of the lye into cellulose molecules. The bicarbonate solution can penetrate a crystallization region of the cellulose to increase the void volume of the fiber. Therefore, the catalyst and the auxiliary agent are simultaneously added into the reaction system. In particular, when the polyether water-soluble organic matter is compounded with the bicarbonate as the auxiliary agent, their synergistic could be used to effect strengthen the penetration and evacuation of the Juncao fiber, accelerate the oxidative degradation of the fiber, reduce the degree of polymerization of the fiber, effectively reduce the fiber viscosity and improve the reaction performance.

The above are specific embodiments of the present disclosure but are not limited by the above embodiments. Any other combinations, changes, modifications, substitutions, and simplifications that do not exceed the design idea of the present disclosure shall fall within the protection scope of the present disclosure.

What is claimed is:

1. A method for preparing a Juncao pulp for spinning, comprising:

placing a Juncao raw material in a solution prepared from a lye, a catalyst, and an auxiliary agent and cooking to obtain a cooked mixture; and then subjecting the cooked mixture to pulping to obtain the Juncao pulp for spinning;

wherein the catalyst is a metal chloride salt, and the auxiliary agent is a polyether water-soluble organic matter and a bicarbonate;

the metal chloride salt is at least one selected from the group consisting of cobalt chloride, calcium chloride, ferric chloride, ferrous chloride, and nickel chloride;

the polyether water-soluble organic matter is polyethylene oxide;

the Juncao raw material is calculated based on a dry Juncao; the polyether water-soluble organic matter is calculated based on an active ingredient; an additive amount of the catalyst is in a range of 0.01 wt % to 0.3 wt % of the Juncao raw material; an additive amount of the bicarbonate is in a range of 0.01 wt % to 0.1 wt % of the Juncao raw material; and a volume/mass ratio of the polyether water-soluble organic matter to the Juncao raw material is in a range of (1-12)/(2-3) mL/kg.

2. The method of claim 1, wherein the polyethylene oxide has a degree of polymerization of 9 to 12.

3. The method of claim 2, wherein the bicarbonate is selected from the group consisting of sodium bicarbonate and potassium bicarbonate.

4. The method of claim 1, wherein the lye is selected from the group consisting of a potassium hydroxide solution and a sodium hydroxide solution; and the lye has a concentration of 105 g/L to 120 g/L.

5. The method of claim 1, wherein the cooking is conducted at a temperature of 160° C. to 175° C.; and the cooking is conducted for 4 h to 6 h.

6. The method of claim 1, further comprising subjecting the Juncao raw material to a pretreatment before cooking;

wherein the pretreatment is conducted by a first process comprising: subjecting the Juncao raw material to cutting, disinfection, and drying, then screening to obtain an internode Juncao, and subjecting the internode Juncao to high-temperature preheating, then cooking.

7. The method of claim 6, wherein the disinfection is conducted with a disinfectant, and the disinfectant is at least one selected from the group consisting of an alcohol solution, an acid solution, and a diol derivative; and the disinfection is conducted at a temperature of 25° C. to 45° C.

8. The method of claim 7, wherein the first process further comprises after the high-temperature preheating, washing the Juncao raw material repeatedly with water, the washing being conducted at a temperature of 30° C. to 100° C.; and the high-temperature preheating is conducted for 30 min to 120 min.

9. The method of claim 6, wherein the first process further comprises after the high-temperature preheating, washing the Juncao raw material repeatedly with water, the washing being conducted at a temperature of 30° C. to 100° C.; and the high-temperature preheating is conducted for 30 min to 120 min.

10. The method of claim 1, wherein subjecting the cooked mixture to the pulping is performed by a second process comprising: subjecting the cooked mixture to beating and bleaching to obtain a bleached pulp, and subjecting the bleached pulp to papermaking and molding to obtain the Juncao pulp for spinning.

11. The method of claim 10, wherein the beating is conducted with a rotation speed of 8.0 r/s to 8.5 r/s; the beating is conducted at a temperature of 15° C. to 35° C.; the beating is conducted with a belt transmission ratio of 260 to 285; and the beating is conducted for 0.5 h to 1 h;

the bleaching is conducted with a bleaching agent, and the bleaching agent is any one selected from the group consisting of hydrogen peroxide, chlorine dioxide, sodium hypochlorite, and calcium hypochlorite; the bleaching is conducted for 10 min to 60 min; and the bleaching is conducted at a temperature of 30° C. to 70° C.; and the papermaking is conducted on the bleached pulp with desalted water in a spraying amount of 30 $m^3$/h to 45 $m^3$/h.

12. The method of claim 10, wherein after subjecting the cooked mixture to beating and bleaching, and before subjecting the bleached pulp to papermaking and molding to obtain the Juncau pulp for spinning, the second process further comprises adding an ash-iron removal agent to the bleached pulp; wherein the ash-iron removal agent is added in an amount of 0.01% to 0.08% of a bone dry pulp.

13. The method of claim 1, wherein the cooking is conducted at a temperature of 160° C. to 175° C.; and the cooking is conducted for 4 h to 6 h.

14. A Juncao pulp for spinning prepared by the method of claim 1, wherein the Juncao pulp for spinning has a fiber viscosity of 14 mPa·s to 20 mPa·s, an α-cellulose content of not less than 91%, a pentosan content of less than 4.92%, a resin content of less than 0.13%, and a reaction performance of 0 s to 250 s; the fiber viscosity is determined by a cuprammonium method; and the reaction performance is determined by a viscose filtration method.

* * * * *